US007364046B2

(12) United States Patent
Joshi et al.

(10) Patent No.: US 7,364,046 B2
(45) Date of Patent: Apr. 29, 2008

(54) CIRCUMFERENTIAL STIFFENING RIB FOR HOT-FILL CONTAINERS

(75) Inventors: Rohit V Joshi, Ann Arbor, MI (US); Michael T Lane, Brooklyn, MI (US); Richard J Steih, Britton, MI (US)

(73) Assignee: Amcor Limited, Abbotsford, Victoria (AU)

( * ) Notice: Subject to any disclaimer, the term of this patent is extended or adjusted under 35 U.S.C. 154(b) by 416 days.

(21) Appl. No.: 11/064,610

(22) Filed: Feb. 24, 2005

(65) Prior Publication Data

US 2006/0186083 A1 Aug. 24, 2006

(51) Int. Cl.
*B65D 1/02* (2006.01)
*B65D 1/46* (2006.01)

(52) U.S. Cl. ..... 215/381; 215/382; 220/672; 220/675

(58) Field of Classification Search ..... 215/379–383, 215/384; 220/669, 672, 675
See application file for complete search history.

(56) References Cited

U.S. PATENT DOCUMENTS

| | | | | |
|---|---|---|---|---|
| 4,497,855 | A | 2/1985 | Agrawal et al. | |
| 4,805,788 | A | 2/1989 | Akiho | |
| 5,261,543 | A | 11/1993 | Ugarelli | |
| 5,337,909 | A | 8/1994 | Vailliencourt | |
| 5,341,946 | A | 8/1994 | Vailliencourt et al. | |
| D352,238 | S | 11/1994 | Vailliencourt et al. | |
| D366,416 | S | 1/1996 | Semersky | |
| D366,831 | S | 2/1996 | Semersky et al. | |
| 5,632,397 | A | 5/1997 | Fandeux et al. | |
| 5,704,503 | A | 1/1998 | Krishnakumar et al. | |
| 5,704,504 | A | 1/1998 | Bueno | |
| 6,016,932 | A | 1/2000 | Gaydosh et al. | |
| 6,036,037 | A | 3/2000 | Scheffer et al. | |
| 6,062,409 | A | 5/2000 | Eberle | |
| 6,223,920 | B1 | 5/2001 | Lane et al. | |
| 6,230,912 | B1 | 5/2001 | Rashid | |
| 6,296,131 | B2 | 10/2001 | Rashid | |
| 6,347,717 | B1 | 2/2002 | Eberle | |
| 6,497,333 | B1 | 12/2002 | Ellis et al. | |
| D491,808 | S | 6/2004 | Lane et al. | |
| D491,812 | S * | 6/2004 | Eberle et al. | D9/516 |
| 6,932,230 | B2 * | 8/2005 | Pedmo et al. | 215/381 |

FOREIGN PATENT DOCUMENTS

| | | | |
|---|---|---|---|
| JP | 2004026165 A | * | 1/2004 |
| WO | WO99/08945 | | 2/1999 |

* cited by examiner

*Primary Examiner*—Sue A. Weaver
(74) *Attorney, Agent, or Firm*—Harness, Dickey & Pierce, P.L.C.

(57) ABSTRACT

A polymer container suitable for hot-filling featuring at least one circumferential rib having a plurality of varying width regions transitioning from a smaller dimension area, to a larger dimension area, to the smaller dimension area. The larger dimension area is adjacent a land area between any two adjacent vacuum panels.

21 Claims, 4 Drawing Sheets

CIRCUMFERENTIAL STIFFENING RIB FOR HOT-FILL CONTAINERS

TECHNICAL FIELD OF INVENTION

This invention generally relates to a container made of polymer materials, such as polyethylene terephthalate (PET) or other similar polyester materials, having at least one circumferential stiffening rib. Moreover, this invention generally relates to a polymer container filled with a liquid at an elevated temperature and quickly sealed with a closure before cooling. As the liquid subsequently cools, the container is subjected to vacuum related forces.

BACKGROUND

Packagers, to ensure adequate sterilization, often fill bottles and containers with liquids or products at an elevated temperature of approximately 180° F. to 205° F. (82° C. to 96° C.) and seal with a closure before cooling. Manufacturers generally refer to this as a "hot-fill" container or as a "hot-filling" process. As the sealed container cools, a slight vacuum, or negative pressure, forms inside causing the container to slightly change shape, particularly when made of polymer materials and generally having a somewhat flexible nature.

Typically, although not always, manufacturers produce these hot-fill containers in polyester materials, such as polyethylene terephthalate (PET), using a "stretch blow-molding" process, well known in the art, that substantially biaxially orients material molecular structure within the container. While PET materials are typical, other polymer materials, such as polypropylene, polyethylene, polycarbonate, and other polyesters, such as polyethylene naphthalate, are feasible using a variety of container production processes, also well known in the art, which may or may not establish the biaxial oriented material molecular structure.

Container and bottle designers attempting to control the change-in-shape from hot-fill often incorporate a plurality of generally recessed vacuum panels within the sidewalls around the container's body. Those skilled in the art are well aware of a variety of vacuum panel configurations. The vacuum panels tend to focus the change-in-shape allowing the container to retain a pleasing generally uniform appearance. Retaining the pleasing generally uniform appearance is an important consideration to the packager and its customers. If the container should collapse in an un-uniform manner, the container appearance becomes less pleasing and the customer becomes reluctant to purchase, believing the product damaged.

Packagers attempting to reduce cost, require containers to have less material or to be lighter in weight. Accordingly, containers lighter in weight are more vulnerable to unwanted changes-in-shape. FIG. 1 illustrates a typical container having a plurality of vacuum panels. The area (generally illustrated in FIG. 1 as a shaded circular spot) above and/or below any adjacent pair of vacuum panels is often vulnerable to unwanted collapse. FIG. 2 is a bottom view of the container shown in FIG. 1 illustrating its typical generally circular configuration.

Container and bottle designers further attempting to control unwanted changes-in-shape have added reinforcing grooves or ribs (not illustrated) at or near the shaded circular spots shown on FIG. 1. Those skilled in the art are aware of a number of variations. Unfortunately, as packagers continue to remove additional weight from the container, to further reduce cost, reinforcing grooves or ribs have been found to become inadequate.

Accordingly, the inventors have discovered a new and novel rib configuration which is more adequate for controlling unwanted changes-in-shape of the polymer container, in particular of the polyester polymer container.

SUMMARY OF INVENTION

A polymer container includes a neck finish portion suitable for receiving a closure, a shoulder portion adjacent the neck finish portion, a body portion adjacent the shoulder portion, the body portion having a plurality of vacuum panels formed therein and a land area between any adjacent pair of vacuum panels, and a bottom portion adjacent the body portion. The polymer container further includes a circumferential rib adjacent to at least one of the shoulder portion and the bottom portion. The circumferential rib defined in part by a plurality of varying width regions. The varying width regions transition from and oscillate between a smaller dimension area, to a larger dimension area, to the smaller dimension area. The larger dimension area of the varying width regions of the circumferential rib is adjacent the land area. The circumferential rib has a depth at least equal to 25 percent of a width of the smaller dimension area.

In a preferred configuration, each region of the plurality of varying width regions of the circumferential rib is continuous, joining and transitioning into each adjacent region of the plurality of varying width regions. Also in the preferred configuration, each region of the plurality of varying width regions of the circumferential rib is substantially symmetrical on either side of an imaginary, horizontal plane located along a centerline extending through the circumferential rib.

In an alternative configuration, each region of the plurality of varying width regions of the circumferential rib is disconnected and separated from each adjacent region of the plurality of varying width regions. While the above-described symmetrical configuration is preferred, another alternative is for each region of the plurality of varying width regions of the circumferential rib to be asymmetrical to an imaginary, horizontal plane located along a centerline extending through the circumferential rib. In another alternative, the asymmetrical circumferential rib includes an edge which is substantially parallel to an imaginary, horizontal plane located along a centerline extending through the circumferential rib and an opposite edge which is in part non-parallel to the imaginary plane. In the case of the asymmetrical circumferential rib configuration, the location of the opposite edge being in part non-parallel to the imaginary plane is preferred to be adjacent to the land area between any two adjacent vacuum panels.

From the following description, the appended claims, and the accompanying drawings, additional benefits and advantages of the present invention will become apparent to those skilled in the art to which this invention relates.

DETAILED DESCRIPTION

Figure 1:
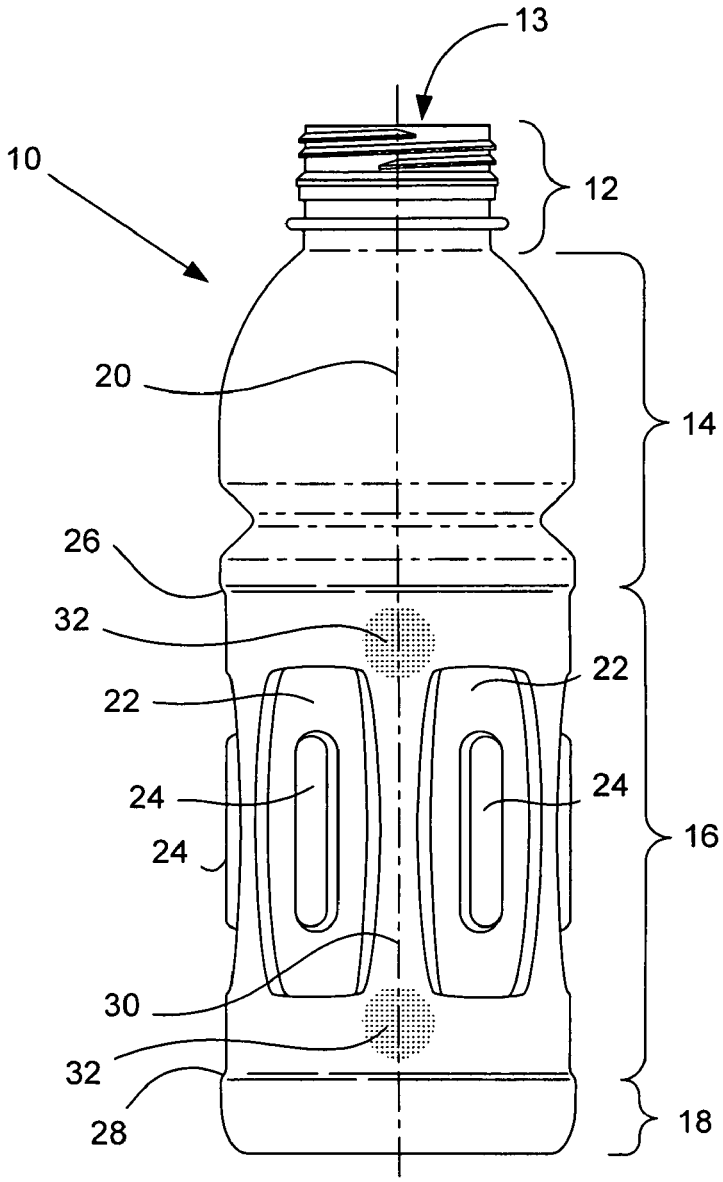
FIG. 1 is an elevational view of a typical hot-fill container showing areas where container collapse often occurs.
Figure 2:
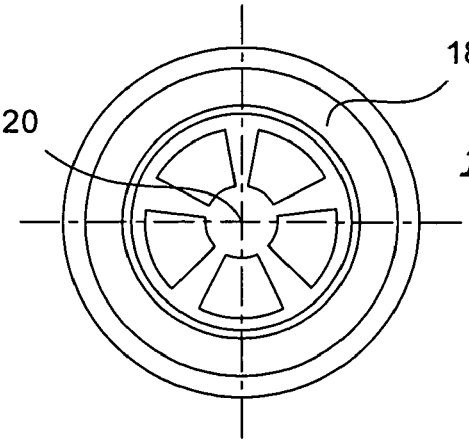
FIG. 2 is a bottom view of the container in FIG. 1.

FIG. 1 illustrates a typical hot-fillable container 10 made of a polymer material, such as polypropylene, polyethylene terephthalate (PET), or other polymer materials. Container 10 has a neck finish portion 12 with an opening 13 suitable to receive a closure (not shown), a shoulder portion 14, a body portion 16, and a bottom portion 18 all having a centerline 20. FIG. 2 is a bottom view of container 10 showing its generally circular configuration about its centerline 20. In the preferred embodiment, container manufacturers will manufacture container 10 using a well-known stretch-molding heat-setting process wherein, the polymer material is generally molecularly oriented, that is, the polymer material molecular structure is mostly biaxially oriented. The exception is that the molecular structure of some material within the neck finish portion 12 and some material within sub-portions of the bottom portion 18 may not be substantially biaxially oriented.

The well-known stretch-molding heat-setting process for making the hot-fillable container 10 generally involves first manufacture of a preform (not illustrated) of a polyester material, such as polyethylene terephthalate, having a shape well known to those skilled in the art similar to a test-tube with a generally cylindrical cross-section with a length approximately 50 percent that of the container height. A machine (not illustrated) places the preform heated to a temperature between approximately 190° F. to 250° F. (88° C. to 121° C.) into a mold cavity (not illustrated) having a shape similar to the container 10 and at a temperature between approximately 250° F. to 350° F. (121° C. to 176° C.). A stretch rod apparatus (not illustrated) stretches or extends the heated preform within the mold cavity to a length approximately that of the container thereby molecularly orienting the polyester material in an axial direction generally corresponding with centerline 20. While the stretch rod is extending the preform, air having a pressure between 300 PSI to 600 PSI (2.068 MPa to 4.137 MPa) assists extending the preform in the axial direction while expanding the preform in a circumferential or hoop direction thereby substantially conforming the polyester material to the shape of the mold cavity and further molecularly orienting the polyester material in a direction generally perpendicular to the axial direction thus establishing the biaxial molecular orientation of the polyester material in most of the container. The pressurized air holds the mostly biaxially oriented polyester material against the mold cavity for a period of approximately 2 to 5 seconds before removal of the container from the mold cavity.

The body portion of container 10 features an upper label panel edge or indent 26, a lower label panel edge or indent 28 and a plurality of vacuum panels 22. Typically, container designers use between four to eight vacuum panels with six vacuum panels being the most common. The vacuum panels 22 illustrated in FIG. 1 are of a typical generally recessed configuration featuring standing island 24 geometry. Those skilled in the art are aware of several alternative vacuum panel configurations which are common, including vacuum panels having ribs, logo embossments, and other similar geometric features. Between any pair of adjacent vacuum panels 22 is a land area 30.

Container 10 is for hot-fill applications where bottlers fill the container 10 with a liquid or product at an elevated temperature between approximately 180° F. to 205° F. (82° C. to 96° C.) and seal with a closure before cooling (not illustrated). As the sealed container cools, a slight vacuum, or negative pressure, forms inside causing the container to slightly change shape (not illustrated), particularly, when made of lightweight polymer materials and thus generally having a somewhat flexible nature. Container and bottle designers attempting to control the change-in-shape from hot-fill incorporate vacuum panels 22 around the container's body portion 16 to focus the change-in-shape allowing the container 10 to retain a pleasing generally uniform appearance. Packagers and bottlers attempting to reduce cost, require containers to have less material or be lighter in weight. Accordingly, containers lighter in weight are more vulnerable to unwanted changes-in-shape or collapse. The area generally illustrated in FIG. 1 as a shaded circular spot 32, above and/or below any adjacent pair of vacuum panels 22, is often vulnerable to unwanted collapse.

Figure 3:
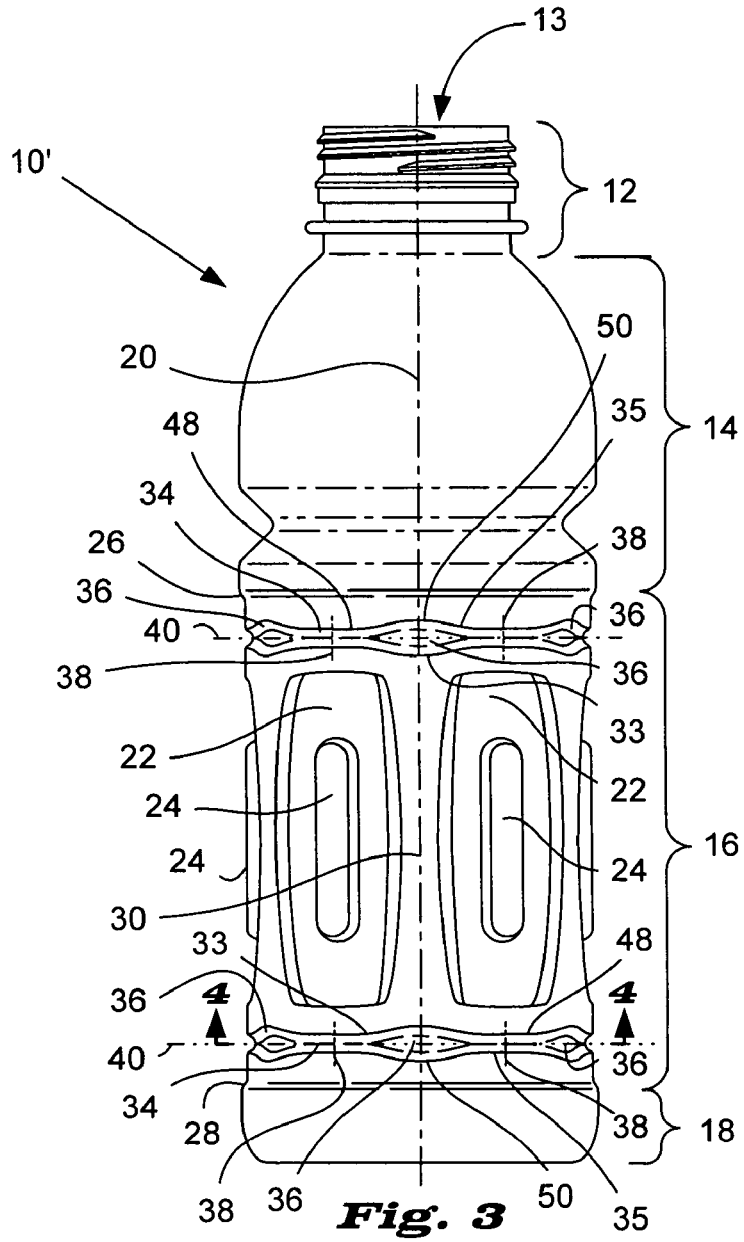
FIG. 3 is an elevational view of a container constructed in accordance with the teachings of a preferred embodiment of the present invention.

Otherwise similar to container 10 illustrated in FIG. 1, FIG. 3 illustrates container 10' featuring a circumferential rib 34 in its preferred embodiment. Circumferential rib 34 features a plurality of varying width regions 36 having end-points 38 that merge with each other in a continuous fashion. In other words, the end-point 38 of one varying width region 36 overlays the end-point 38 of the next or adjacent varying width region 36 thereby making circumferential rib 34 a continuous locus of varying width regions 36 that encircle container 10'. In the preferred embodiment, varying width regions 36 include a smaller width dimension area 48, designated as SW in FIG. 5, located approximately at and near the end-points 38 and a larger width dimension area 50, designated as LW in FIG. 6, located approximately half way between end-points 38 of any one varying width regions 36. As illustrated, the larger width dimension area 50 of varying width regions 36 is adjacent to land area 30, while the smaller width dimension area 48 is adjacent to vacuum panels 22. In the preferred embodiment, circumferential rib 34 is substantially symmetrical on either side of an imaginary, horizontal plane 40 located along a centerline extending through the circumferential rib 34, and varying width regions 36 feature a configuration that smoothly transitions from and oscillates between smaller width dimension area 48 to larger width dimension area 50. The container 10' can feature one or more circumferential rib 34 configurations. Often container 10' will feature one circumferential rib 34 adjacent to shoulder portion 14 and one circumferential rib 34 adjacent to bottom portion 18.

Figure 4:
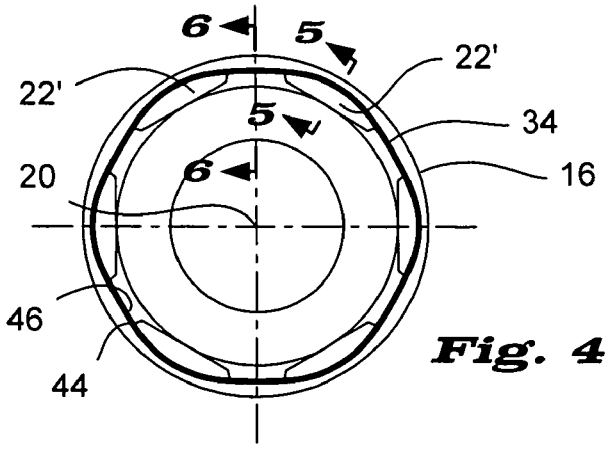
FIG. 4 is a cross-sectional view taken along line 4-4 in FIG. 3.

FIG. 4 is a cross-sectional view of container 10' in FIG. 3 taken along line 4-4 showing its generally circular configuration. FIG. 4 illustrates an interior portion 22' of vacuum panels 22. Container 10' further includes an exterior surface 44 and an interior surface 46.

Figure 5:
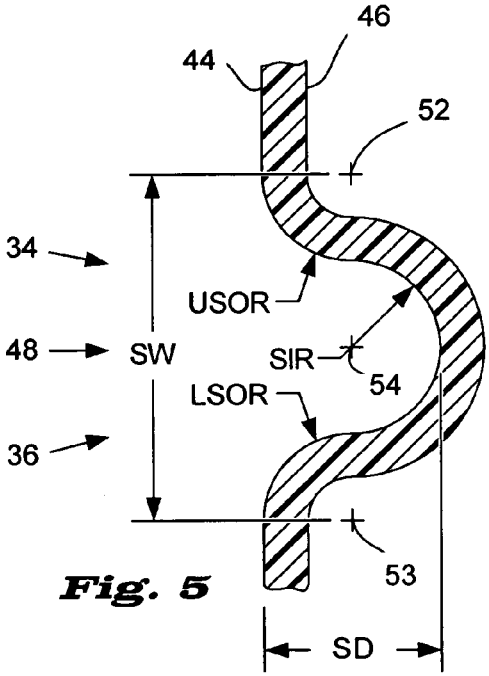
FIG. 5 is an enlarged partial cross-sectional view taken along line 5-5 in FIG. 4.

FIG. 5 is an enlarged partial cross-sectional view of circumferential rib 34 illustrating the smaller width dimension area 48 of varying width regions 36 and further illustrating the circumferential rib 34 preferred geometrical relationship with respect to the smaller width dimension area 48. On the exterior surface 44, circumferential rib 34 in cross-section has an upper small outside radius dimension USOR and a lower small outside radius dimension LSOR each having a center point 52 and 53, respectively, and a small inside radius dimension SIR having a center point 54 and tangent to upper small outside radius dimension USOR and lower small outside radius dimension LSOR. Circumferential rib 34 has a small width dimension SW taken between the center points 52 and 53, and a small depth dimension SD taken between the exterior surface 44 and a point deepest on small inside radius dimension SIR. Upper small outside radius dimension USOR and lower small outside radius dimension LSOR each have a value generally less than 50 percent that of small width dimension SW. The value of upper small outside radius dimension USOR and lower small outside radius dimension LSOR are preferably between equal to or less than 30 percent of small width dimension SW and equal to or greater than 10 percent of small width dimension SW. Small inside radius dimension SIR has a value generally less than 50 percent that of small width dimension SW and suitable to smoothly accommodate upper small outside radius dimension USOR, lower small outside radius dimension LSOR and small depth dimension SD. Small depth dimension SD has a value generally equal to or less than 50 percent that of small width dimension SW, but equal to or greater than 25 percent of small width dimension SW. For any selected value of small width dimension SW, the following mathematical formulas generally express the preferred relationships for smaller width dimension area 48 of circumferential rib 34:

| | |
|---|---|
| $0.25\ SW \leqq SD \leqq 0.5\ SW$ | |
| $0 < USOR < 0.5\ SW$ | preferably: $0.1\ SW \leqq USOR \leqq 0.3\ SW$ |
| $0 < LSOR < 0.5\ SW$ | preferably: $0.1\ SW \leqq LSOR \leqq 0.3\ SW$ and preferably: $USOR = LSOR$ |
| $0 < SIR < 0.5\ SW$. | |

Those skilled in the art will be able to easily select an appropriate value for small inside radius dimension SIR permitting the small inside radius to be tangent with selected upper small outside radius dimension USOR and lower small outside radius dimension LSOR, and to smoothly accommodate selected small width dimension SW and small depth dimension SD. While the upper small outside radius dimension USOR and the lower small outside radius dimension LSOR preferably have the same value, except for previously stated embodiments, it is not a requirement that the upper small outside radius dimension USOR and the lower small outside radius dimension LSOR be the same value. By way of example, for container 10' having a capacity of approximately one liter, small width dimension SW typically is approximately 0.150 inches (3.81 mm). Accordingly, small depth dimension SD is typically in a range from approximately 0.038 inches (0.97 mm) to approximately 0.075 inches (1.91 mm). Upper small outside radius dimension USOR and lower small outside radius dimension LSOR are preferably in a range from approximately 0.015 inches (0.38 mm) to approximately 0.045 inches (1.14 mm).

Figure 6:
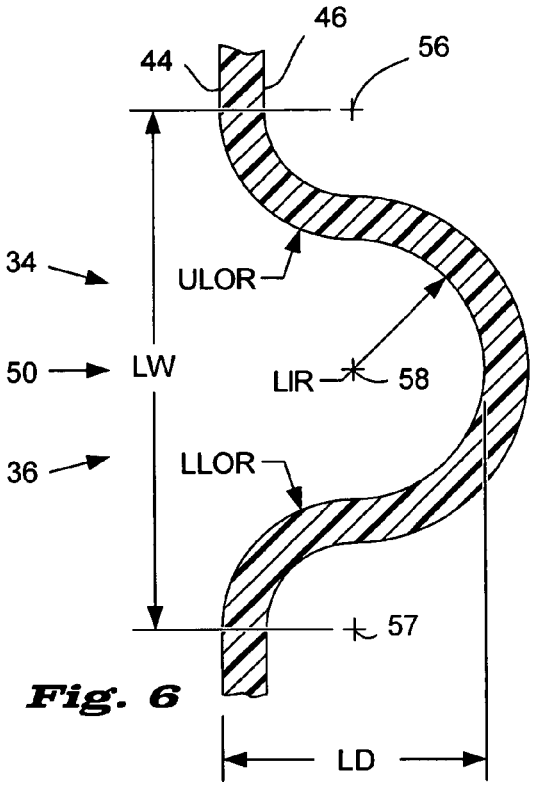
FIG. 6 is an enlarged partial cross-sectional view taken along line 6-6 in FIG. 4.

FIG. 6 is an enlarged partial cross-sectional view of circumferential rib 34 illustrating the larger width dimension area 50 of varying width regions 36 and further illustrating the circumferential rib 34 preferred geometrical relationship with respect to the larger width dimension area 50. On the exterior surface 44, circumferential rib 34 in cross-section has an upper large outside radius dimension ULOR and a lower large outside radius dimension LLOR each having a center point 56 and 57, respectively, and a large inside radius dimension LIR having a center point 58 and tangent to upper large outside radius dimension ULOR and lower large outside radius dimension LLOR. Preferably, upper large outside radius dimension ULOR is equal to or larger than upper small outside radius dimension USOR of FIG. 5, while lower large outside radius dimension LLOR is equal to or larger than lower small outside radius dimension LSOR of FIG. 5. Circumferential rib 34 has a large width dimension LW taken between the center points 56 and 57, and a large depth dimension LD taken between the exterior surface 44 and a point deepest on large inside radius dimension LIR. Large width dimension LW has a value from approximately 50 percent to approximately 100 percent greater than small width dimension SW of FIG. 5. Large depth dimension LD has a value generally equal to or less than 50 percent of large width dimension LW, but not less than small depth dimension SD of FIG. 5. Upper large outside radius dimension ULOR and lower large outside radius dimension LLOR each have a value generally less than 50 percent, and preferably equal to or less than 30 percent, that of large width dimension LW. Large inside radius dimension LIR has a value generally less than 50 percent that of large width dimension LW. For any selected value of small width dimension SW, the following mathematical formulas generally express the preferred relationship for larger width dimension area 50 of circumferential rib 34 relative to smaller width dimension area 48:

| | |
|---|---|
| $1.5\ SW \leqq LW \leqq 2\ SW$ | |
| $SD \leqq LD \leqq 0.5\ LW$ | |
| $0 < ULOR < 0.5\ LW$ | preferably: $USOR \leqq ULOR \leqq 0.3\ LW$ |
| $0 < LLOR < 0.5\ LW$ | preferably: $LSOR \leqq LLOR \leqq 0.3\ LW$ and preferably: $ULOR = LLOR$ |
| $0 < LIR < 0.5\ LW$. | |

Those skilled in the art will be able to easily select appropriate values for upper large outside radius dimension ULOR, lower large outside radius dimension LLOR, and large inside radius dimension LIR to smoothly accommodate selected large width dimension LW and large depth dimension LD. While the upper large outside radius dimension ULOR and the lower large outside radius dimension LLOR preferably have the same value, except for previously stated embodiments, it is not a requirement that the upper large outside radius dimension ULOR and the lower large outside radius dimension LLOR be the same value. By way of example, for container 10' having a capacity of approximately one liter and the small width dimension SW of 0.150 inches (3.81 mm), large width dimension LW is typically in a range from approximately 0.225 inches (5.72 mm) to approximately 0.300 inches (7.62 mm). Large depth dimension LD is as great as 0.150 inches (3.81 mm), but not less than the value of small depth dimension SD. Preferably upper large outside radius dimension ULOR and lower large outside radius dimension LLOR are as great as 0.090 inches (2.29 mm), but more preferably not less than the value of respective upper small outside radius dimension USOR and lower small outside radius dimension LSOR.

Figure 7:
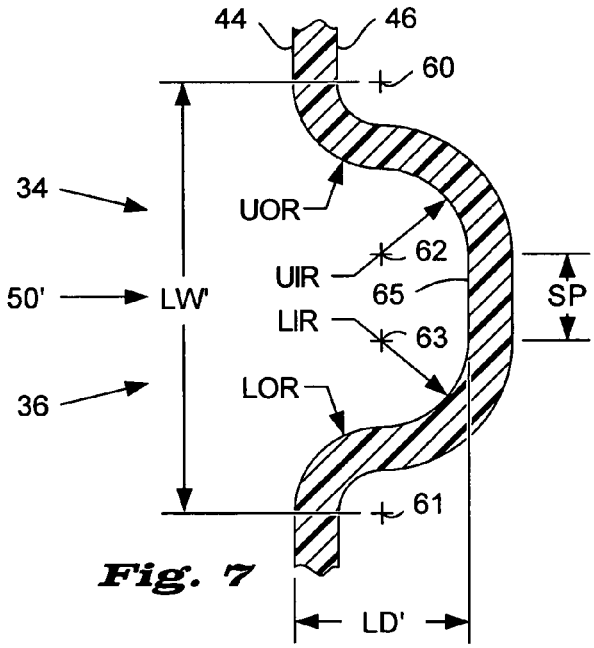
FIG. 7 is an enlarged partial cross-sectional view of an alternative embodiment similar to FIG. 6.

FIG. 7 is an enlarged partial cross-sectional view of circumferential rib 34 illustrating an alternative embodiment to that shown in FIG. 6 of the larger width dimension area 50' geometrical relationship with respect to varying width regions 36 shown. On the exterior surface 44, circumferential rib 34 in cross-section has an upper outside radius dimension UOR and a lower outside radius dimension LOR each having a center point 60 and 61, respectively, and each having a value equal to or slightly greater than respective upper small outside radius dimension USOR and lower small outside radius dimension LSOR of FIG. 5. Circumferential rib 34 has a large width dimension LW' taken between the center points 60 and 61, an outside interior surface 65, and a large depth dimension LD' taken between the exterior surface 44 and the outside interior surface 65 of larger width dimension area 50'. Large width dimension LW' has a value from approximately 50 percent to approximately 100 percent greater than small width dimension SW of FIG. 5. Large depth dimension LD' has a value generally equal to or less than 50 percent that of large width dimension LW', but not less than small depth dimension SD of FIG. 5. Circumferential rib 34 in the embodiment of larger width dimension area 50' shown in FIG. 7 has an upper inside radius dimension UIR and lower inside radius dimension LIR each having a center point 62 and 63, respectively, and tangent to their respective upper outside radius dimension UOR and lower outside radius dimension LOR. Upper inside radius dimension UIR and lower inside radius dimension LIR preferably have a value equal to or slightly greater than small inside radius dimension SIR of FIG. 5. Tangent to both upper inside radius dimension UIR and lower inside radius dimension LIR is a substantially straight portion SP that in cross-section can generally be a straight line or a gentle curvature having a length equal to or greater than large width dimension LW' less upper outside radius dimension UOR, upper inside radius dimension UIR, lower inside radius dimension LIR, and lower outside radius dimension LOR. For any selected value of small width dimension SW, the following mathematical formulas generally express for the alternative embodiment of larger width dimension area 50' of circumferential rib 34 relative to smaller width dimension area 48:

| | |
|---|---|
| $1.5\ SW \leqq LW' \leqq 2\ SW$ | |
| $SD \leqq LD' \leqq 0.5\ LW'$ | |
| $0 < UOR < 0.5\ LW'$ | preferably: UOR = USOR |
| $0 < LOR < 0.5\ LW'$ | preferably: LOR = LSOR |
| $0 < UIR < 0.5\ LW'$ | preferably: UIR = SIR |
| $0 < LIR < 0.5\ LW'$ | preferably: LIR = SIR |
| $SP \geqq LW' - (UOR + LOR + UIR + LIR).$ | |

$$SP \geqq LW' - (UOR + LOR + UIR + LIR).$$

As appropriate, upper small outside radius dimension USOR, lower small outside radius dimension LSOR, upper large outside radius dimension ULOR, lower large outside radius dimension LLOR, upper outside radius dimension UOR and lower outside radius dimension LOR generally correspond to a first edge 33 or a second edge 35 of circumferential rib 34. The first edge 33 is adjacent to vacuum panels 22. The second edge 35 as appropriate is adjacent to either shoulder portion 14 or bottom portion 18. Between the first edge 33 and the second edge 35 is the imaginary, horizontal plane 40. FIG. 3 illustrates a preferred configuration wherein first edge 33 and second edge 35 are substantially symmetrical, mirror images of each other relative to imaginary, horizontal plane 40.

Figure 8:
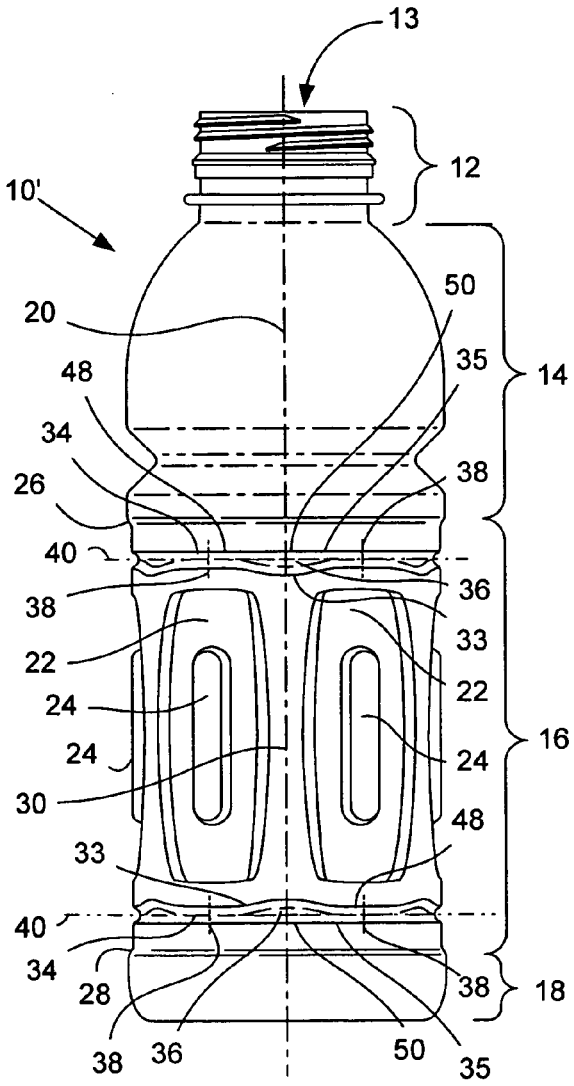
FIG. 8 is an elevational view of a container constructed in accordance with the teachings of an alternative embodiment of the present invention.

FIG. 8 illustrates an alternative configuration of circumferential rib 34 relative to imaginary, horizontal plane 40 wherein first edge 33 is not symmetrical with second edge 35. In a preferred configuration of the FIG. 8 alternative, the larger width dimension area 50 of the varying width regions 36 vary solely along first edge 33, while second edge 35 adjacent to either shoulder portion 14 or base portion 18 remains substantially parallel to imaginary, horizontal plane 40. Accordingly, because first edge 33 is adjacent to vacuum panels 22 and the larger width dimension area 50 of varying width regions 36 is adjacent to land area 30, the alternative embodiment illustrated in FIG. 8 emphasizes how varying width regions 36 penetrate land area 30 between any two adjacent vacuum panels 22.

Figure 9:
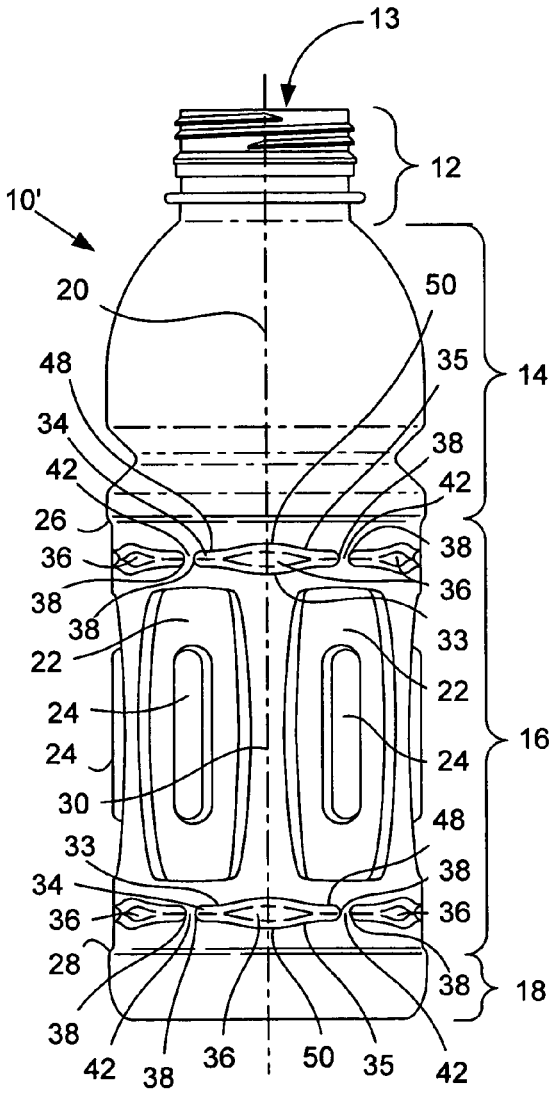
FIG. 9 is an elevational view of a container constructed in accordance with the teachings of another alternative embodiment of the present invention.

FIG. 9 illustrates another alternative configuration of circumferential rib 34 wherein a space 42 separates the end-points 38 of adjacent varying width regions 36. Accordingly, circumferential rib 34 becomes a series of distinct varying width regions 36 encircling container 10'.

The foregoing describes certain preferred embodiments and alternatives, and one must understand that other variations are feasible that do not depart from the spirit and scope of the inventions as defined by the appended claims.

We claim:

1. A polymer container comprising:

a neck finish portion suitable for receiving a closure;

a shoulder portion adjacent said neck finish portion;

a body portion adjacent said shoulder portion, said body portion having a plurality of vacuum panels formed therein and a land area between any adjacent pair of said vacuum panels;

a bottom portion adjacent said body portion; and a circumferential rib adjacent to at least one of said shoulder portion and said bottom portion; said circumferential rib defined in part by a plurality of varying width regions which transition from a smaller vertical dimension area, to a larger vertical dimension area, to said smaller vertical dimension area; wherein said larger vertical dimension area is adjacent said land area; said circumferential rib having a depth at least equal to 25 percent of a width of said smaller vertical dimension area.

2. The container according to claim 1, wherein each varying width region of said plurality of varying width regions of said circumferential rib is continuous and joins with each adjacent varying width region of said plurality of varying width regions.

3. The container according to claim 1, wherein each varying width region of said plurality of varying width regions of said circumferential rib is substantially symmetrical on either side of a horizontal plane extending through a centerline of said circumferential rib.

4. The container according to claim 1, wherein each varying width region of said plurality of varying width regions of said circumferential rib is disconnected and separated from each adjacent varying width region of said plurality of varying width regions.

5. The container according to claim 1, wherein each varying width region of said plurality of varying width regions of said circumferential rib is asymmetrical to a horizontal plane extending through a centerline of said circumferential rib.

6. The container according to claim 5, wherein one edge of said circumferential rib is substantially parallel to said horizontal plane and an opposite edge is in part non-parallel to said horizontal plane.

7. The container according to claim 6, wherein said opposite edge is adjacent to said land area.

8. The container according to claim 1, wherein said polymer is substantially one of a polyester, a polypropylene, and a polyethylene.

9. The container according to claim 8, wherein said polyester is substantially one of a polyethylene terephthalate and a polyethylene naphthalate.

10. A hot-filled polymer container filled with a liquid at an elevated temperature, sealed with a closure, and cooled thereby establishing a slight vacuum within said container, said container comprising:

a neck finish portion suitable for receiving the closure;

a shoulder portion adjacent said neck finish portion;

a body portion adjacent said shoulder portion, said body portion having a plurality of vacuum panels formed therein and a land area between any adjacent pair of said vacuum panels;

a bottom portion adjacent said body portion; and a circumferential rib adjacent to at least one of said shoulder portion and said bottom portion; said circumferential rib defined in part by a plurality of varying width regions which transition from a smaller vertical dimension area, to a larger vertical dimension area, to said smaller vertical dimension area; wherein said larger vertical dimension area is adjacent said land area; said circumferential rib having a depth at least equal to 25 percent of a width of said smaller vertical dimension area.

11. The container according to claim 10, wherein said temperature of the liquid is between 180° F. to 205° F. (82° C. to 96° C.).

12. The container according to claim 10, wherein said polymer is substantially one of a polyester, a polypropylene, and a polyethylene.

13. The container according to claim 12, wherein said polyester is substantially one of a polyethylene terephthalate and a polyethylene naphthalate.

14. The container according to claim 10, wherein one edge of said circumferential rib is substantially parallel to a horizontal plane extending through a centerline of said circumferential rib and an opposite edge is in part non-parallel to said horizontal plane.

15. The container according to claim 14, wherein said opposite edge is adjacent to said land area.

16. A stretch-molded heat-set polyester container formed within a mold cavity having a temperature of approximately 250° F. to 350° F. (121° C. to 176° C.), said container comprising:

a neck finish portion suitable for receiving a closure;

a shoulder portion adjacent said neck finish portion;

a body portion adjacent said shoulder portion, said body portion having a plurality of vacuum panels formed therein and a land area between any adjacent pair of said vacuum panels;

a bottom portion adjacent said body portion;

a first circumferential rib adjacent said shoulder portion and a second circumferential rib adjacent said bottom portion; said circumferential ribs defined in part by a plurality of varying width regions which transition from a smaller vertical dimension area, to a larger vertical dimension area, to said smaller vertical dimension area;

wherein said larger vertical dimension area is adjacent said land area; said circumferential ribs having a depth at least equal to 25 percent of a width of said smaller vertical dimension area; and a generally biaxially oriented molecular structure.

17. The container according to claim 16, wherein said polyester is substantially a polyethylene terephthalate.

18. The container according to claim 16, wherein each varying width region of said plurality of varying width regions of said circumferential ribs is substantially symmetrical on either side of a horizontal plane extending through a centerline of said circumferential ribs.

19. The container according to claim 16, wherein one edge of said circumferential ribs is substantially parallel to a horizontal plane extending through a centerline of said circumferential ribs and an opposite edge is in part non-parallel to said horizontal plane.

20. The container according to claim 19, wherein said opposite edge is adjacent to said land area.

21. A polymer container comprising:

a neck finish portion suitable for receiving a closure;

a shoulder portion adjacent said neck finish portion;

a body portion adjacent said shoulder portion, said body portion having a plurality of vacuum panels formed therein and a land area between any adjacent pair of said vacuum panels;

a bottom portion adjacent said body portion; and a circumferential rib adjacent to at least one of said shoulder portion and said bottom portion; said circumferential rib defined in part by a plurality of varying width regions which transition from a smaller dimension area, to a larger dimension area, to said smaller dimension area; wherein said larger dimension area is adjacent said land area; said circumferential rib having a depth at least equal to 25 percent of a width of said smaller dimension area, and each varying width region of said plurality of varying width regions of said circumferential rib is asymmetrical to a horizontal plane extending through a centerline of said circumferential rib.

* * * * *

UNITED STATES PATENT AND TRADEMARK OFFICE

CERTIFICATE OF CORRECTION

PATENT NO. : 7,364,046 B2
APPLICATION NO. : 11/064610
DATED : April 29, 2008
INVENTOR(S) : Rohit V. Joshi, Michael T. Lane and Richard J. Steih It is certified that error appears in the above-identified patent and that said Letters Patent is hereby corrected as shown below:

Column 4, line 38, “locus” should be --focus--.

Signed and Sealed this

Twenty-third Day of September, 2008

JON W. DUDAS
*Director of the United States Patent and Trademark Office*